US007826723B2

(12) United States Patent
Rho et al.

(10) Patent No.: US 7,826,723 B2
(45) Date of Patent: Nov. 2, 2010

(54) AUTOMATIC CIRCULATION DEVICE OF WARM WATER

(75) Inventors: Young-Bog Rho, Gunsan-si (KR); Young-Gyu Rho, Gunsan-si (KR)

(73) Assignee: CNTEK, Corp., Short Hills, NJ (US)

( * ) Notice: Subject to any disclaimer, the term of this patent is extended or adjusted under 35 U.S.C. 154(b) by 568 days.

(21) Appl. No.: 10/576,211

(22) PCT Filed: Jun. 10, 2004

(86) PCT No.: PCT/KR2004/001386

§ 371 (c)(1),
(2), (4) Date: Apr. 17, 2006

(87) PCT Pub. No.: WO2005/038356

PCT Pub. Date: Apr. 28, 2005

(65) Prior Publication Data

US 2007/0084421 A1 Apr. 19, 2007

(30) Foreign Application Priority Data

Oct. 15, 2003 (KR) ..... 10-2003-0071615

(51) Int. Cl.
*H05B 3/60* (2006.01)
*F24D 5/00* (2006.01)

(52) U.S. Cl. ..... 392/311; 392/449

(58) Field of Classification Search ..... 392/311–337, 392/386–406, 449–461, 478–496; 122/4 A
See application file for complete search history.

(56) References Cited

U.S. PATENT DOCUMENTS 3,660,635 A * 5/1972 Liebert ..... 392/387
3,968,581 A 7/1976 Tsunoda
4,330,309 A * 5/1982 Robinson, Jr. ..... 62/181
4,498,622 A * 2/1985 Harnish ..... 236/25 R
4,690,102 A 9/1987 Sundquist
5,806,331 A * 9/1998 Brown ..... 62/238.6
5,881,207 A * 3/1999 DeBourg et al. ..... 392/401
6,647,204 B1 11/2003 Hutchinson

FOREIGN PATENT DOCUMENTS

KR 1979-0000084 2/1979
KR 1985-0006474 10/1985
KR 1019920001275 2/1992

* cited by examiner

*Primary Examiner*—Sang Y Paik
(74) *Attorney, Agent, or Firm*—Robert E. Bushnell, Esq.

(57) ABSTRACT

An automatic circulation device of warm water includes a boiler respectively formed with a feed port and a discharging port at the upper side and the lower side thereof, an electric heater horizontally installed at the inner lower side of the boiler without contacting the inner lower side and supplying heat to the interior of the boiler, a water tank connected to the feed port of the boiler by means of a feed pipe and feeding the cool water to the boiler, a heat exchanging section connected to the discharging port of the boiler by means of a discharging pipe and to the water tank by means of a circulation pipe, and transferring heat to the exterior, and a feed valve and a discharging valve respectively installed to the feed pipe and the discharging pipe, and automatically opened and closed by vapor pressure in the boiler. The automatic circulation device continuously produces and circulates the warm water regardless of the distance and height without using a separate pump.

12 Claims, 4 Drawing Sheets

AUTOMATIC CIRCULATION DEVICE OF WARM WATER

TECHNICAL FIELD

The present invention relates to an automatic circulation device of warm water, and more particularly, to an automatic circulation device of warm water including a boiler respectively formed with a feed port and a discharging port at the upper side and the lower side thereof, an electric heater horizontally installed at the inner lower side of the boiler without contacting the inner lower side and supplying heat to the interior of the boiler, a water tank connected to the feed port of the boiler by means of a feed pipe and feeding the cool water to the boiler, a heat exchanging section connected to the discharging port of the boiler by means of a discharging pipe and to the water tank by means of a circulation pipe, and transferring heat to the exterior, and a feed valve and a discharging valve respectively installed to the feed pipe and the discharging pipe, automatically opened and closed by vapor pressure in the boiler, for automatically producing and circulating the warm water without using a circulation pump or other means using other power source, so as to continuously feed the warm water to a heating apparatus such as floors, bedcovers, bedclothes, blankets, or car seats serving as a heating apparatus, and hot pads serving as a physiotherapy apparatus.

BACKGROUND ART

In the conventional manner for supplying heat to floors, hot pads, or the like, electricity is generally utilized, and these conventional blankets, floors, or hot pads to be electrically heated are effective as one of various local heating or keeping warm ways.

However, since the electrical heating device uses an electric heating wire as its heat source, electromagnetic waves harmful to the human body are generated. Researches teach that the minimum intensity of electromagnetic waves harmful to the human body is between 2 mG and 4 mG. Comparing this, the intensity of electromagnetic waves generated from the electric heating device ranges from 50 mG to a value exceeding 1,000 mG.

As described above, since the conventional electric heating device has a shortcoming in that it is harmful to human health, use by the pregnant, the old and weak as well as ordinary people is being limited.

DISCLOSURE

[Technical Problem]

Therefore, the present invention has been made in view of the above problems, and it is an object of the present invention to provide an automatic circulation device of warm water for using warm water as a heat source, which does not generate electromagnetic waves harmful to the human body, for continuously producing and circulating the warm water regardless of distance or height by using the change of water vapor's pressure based on the change of volume when the water is transformed into water vapor and a valve automatically opened and closed according to the pressure change without a separate power source, and thereby capable of securing safety to the human body and achieving low manufacturing costs.

[Technical Solution]

In accordance with an aspect of the present invention, the above and other objects can be accomplished by the provision of an automatic circulation device of warm water including a boiler formed with a feed port and a discharging port at the upper side and the lower side thereof, respectively, receiving cool water through the feed port, and discharging the warm water through the discharging port, an electric heater horizontally installed at the inner lower side of the boiler without contacting the inner lower side and supplying heat to the interior of the boiler, a water tank connected to the feed port of the boiler by means of a feed pipe and feeding the cool water to the boiler, a heat exchanging section connected to the discharging port of the boiler by means of a discharging pipe and to the water tank by means of a circulation pipe, and transferring heat to the exterior, and a feed valve and a discharging valve respectively installed to the feed pipe and the discharging pipe, and automatically opened and closed by vapor pressure in the boiler.

According to an aspect of the present invention, the automatic circulation device of warm water further includes a muffler installed to the discharging pipe downstream of the discharging valve and separating the warm water in the discharging valve from the vapor.

The muffler includes a muffler body having an internal space with a wide upper side and a narrow lower side, and an inclined surface formed at the bottom surface thereof, and an inlet pipe and an outlet pipe respectively connected to the upper side and the lower side of the muffler body.

The automatic circulation device of warm water according to the present invention further includes a temperature controller for measuring temperature in the boiler and controlling the supply of the electric power to the electric heater.

Moreover, the automatic circulation device of warm water further includes a quick connector installed to an inlet port and an outlet port of the heat exchanging section and to the connected portions of the discharging pipe and the circulation pipe, for easily connecting and disconnecting the heat exchanging section to the discharging pipe and the circulation pipe.

The quick connector includes a pair of male plugs formed with protrusions symmetrically protruded from both sides of the male plugs 14*a* and having diameters gradually decreased toward their ends, a pair of female plugs having one side into which the male plugs with the protrusions are inserted and the other side on which silicon tubes and a silicon cover are coupled, and a fixing means respectively installed to a male plug case in which the male plugs are installed at the inside, and to a female plug case in which the female plugs are installed at the inside, so as to adjust the depth of the connection of the male and female plugs.

The discharging pipe disposed downstream of the discharging valve is divided into two sub-pipes, and the automatic circulation device of warm water further includes flow rate adjusting devices respectively installed to the sub-pipes for adjusting the amount of the warm water fed to the heat exchanging section.

According to an aspect of the present invention, the entire surface of the electric heater is sealed with a stainless film for preventing erosion.

The boiler is inclined toward the discharging port at an angle of 3 degrees to 5 degrees.

The discharging valve includes a valve case, a valve stem penetrating a hole formed in the valve case and having one end to which a nut is coupled and the other end formed with a valve head, a valve membrane cover coupled with the valve head for securing watertightness between the hole in the valve case and the valve head, and a compressing spring installed around the valve stem, compressed and fixed by the nut and providing elastic force to the valve membrane cover so that it is biased against the hole of the valve case.

Moreover, the feed valve includes a cone-type feed valve and a cylinder-type feed valve installed to the feed pipe in serial fashion.

The cone-type feed valve includes a valve case, a valve membrane support installed in the valve case of the cone-type feed valve and formed with a water feeding section having a hollow cone shape, and a valve membrane fixed between the valve case of the cone-type feed valve and the valve membrane support of the cone-type feed valve and having a lower end movable upward and downward by the external force. The cylinder-type feed valve includes a valve case, a valve body installed in the valve case of the cylinder-type feed valve and freely moved upward and downward, and a spring having one end fixed to the lower end of the valve case of the cylinder-type feed valve and the other end coupled with the inner upper side of the valve body of the cylinder-type feed valve, and providing an elastic force so that the valve body of the cylinder-type feed valve is raised.

[Advantageous Effects]

As described above, the automatic circulation device of warm water uses warm water as a heat source which does not generate electromagnetic waves harmful to the human body, and continuously produces and circulates the warm water regardless of distance or height by using the change of water vapor's pressure based on the change of volume when the water is transformed into water vapor and a valve automatically opened and closed according to the pressure change without a separate pump, and easily connects and disconnects a heat exchanging section, thereby the automatic circulation device can be safely and conveniently used not only in providing heating for various appliances such as a blanket, a carpet, a floor, a hot pad, or the like but also in providing a heat source for use in laboratory work related to microorganisms and medical instruments, which cannot use electric heaters or motor pumps. Moreover, since the boiler size or the electric heater capacity can be minimized or maximized, the automatic circulation device according to the present invention can be used as a heat source in various fields.

DESCRIPTION OF DRAWINGS

The above and other objects, features and other advantages of the present invention will be more clearly understood from the following detailed description taken in conjunction with the accompanying drawings, in which.

BEST MODE

Hereinafter, the automatic circulation device of warm water according to the preferred embodiments of the present invention will be described in detail with reference to the accompanying drawings.

It should be appreciated that the accompanying drawings have been disclosed for illustrative purposes of the preferred embodiments of the present invention, and the present invention is not restricted by the accompanying drawing and the description with reference to the drawings.

Figure 1:
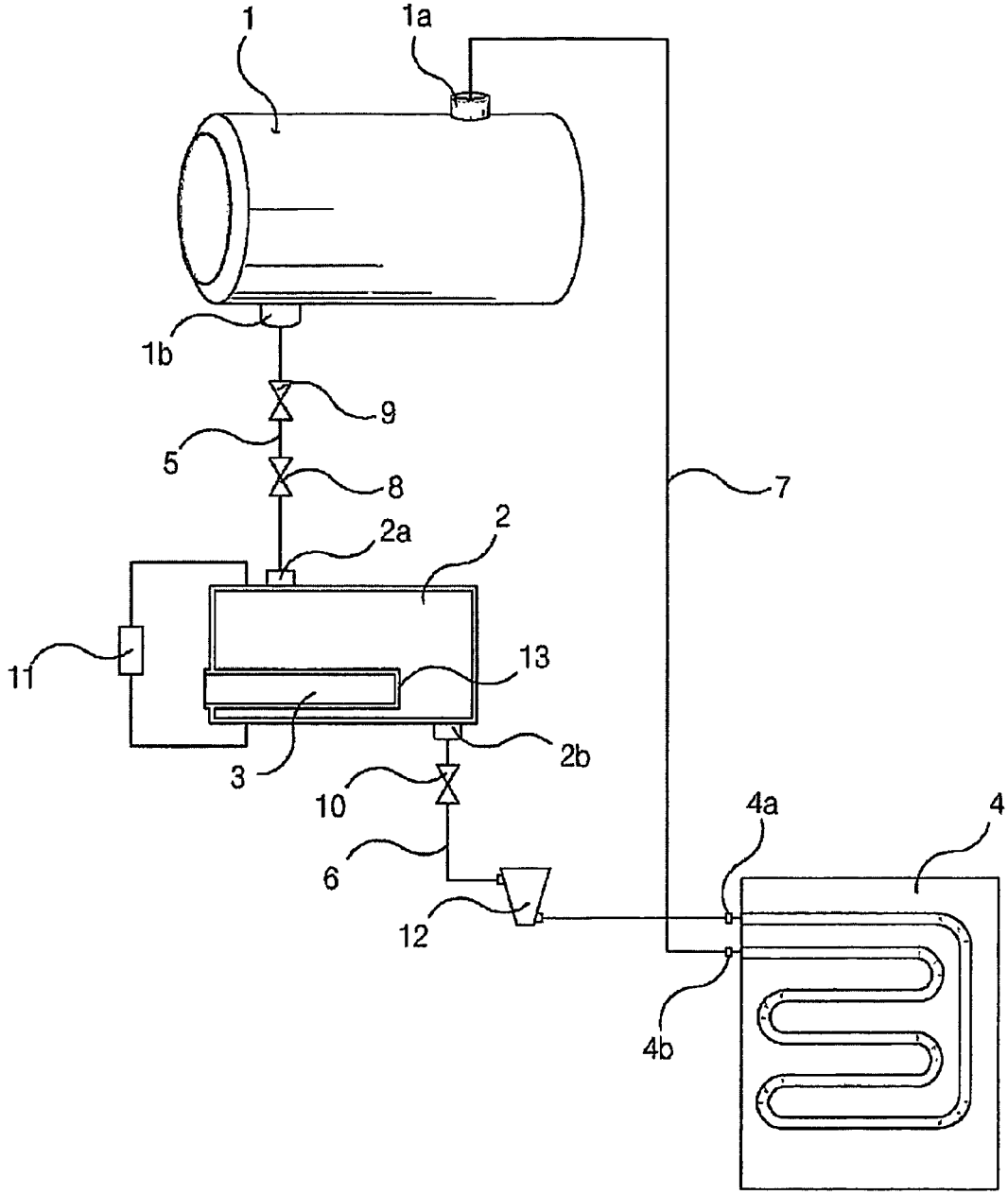
FIG. 1 is a schematic view illustrating an automatic circulation device of warm water according to the present invention.

FIG. 1 is a schematic view illustrating overall structure of the automatic circulation device of warm water according to the present invention.

As shown in FIG. 1, the automatic circulation device of warm water according to the present invention includes a water tank 1, for feeding cool water and storing the circulated cool water, a boiler 2 for receiving the cool water from the water tank 1 and discharging warm water, an electric heater 3 for supplying heat to the inside of the boiler, and a heat exchanging section 4 for using the warm water discharged from the boiler as a heat source and transmitting the heat to the exterior. The automatic circulation device of warm water connects the water tank 1 to the boiler 2 by means of a feed pipe 5, the boiler 2 to the heat exchanging section 4 by means of a discharging pipe 6, and the heat exchanging section 4 to the water tank 1 by means of a circulation pipe 7. The automatic circulation device further includes feed valves 8 and 9 and a discharging valve 10, which are automatically opened and closed by means of internal vapor pressure of the boiler 2 and controlling feeding of the cool water and discharging of the warm water.

The water tank 1 is generally used for the purpose of storing water, and is formed with an inlet 1*a* at the upper side, through which the cool water circulated and returned to the water tank 1 is introduced and an outlet 1*b* at the lower side, through which the cool water is discharged to the boiler 2. The water tank 1 is preferably installed at a higher place than the boiler 2 so as to discharge the cool water to the feed pipe 5 by gravity.

The boiler 2 is formed with a feed port 2*a* at the upper side thereof, which is connected to the feed pipe 5 and through which the cool water is introduced from the water tank 1, and with a discharging port 2*b* at the lower side thereof, which is connected to the discharging pipe 6 and through which the warm water is discharged.

The boiler 2 is preferably installed such that the bottom side thereof is inclined toward the discharging port 2*b* at an angle of 3 degrees to 5 degrees. This is for easily discharging the warm water from the boiler 2 so as to prevent the warm water from being discharged together with the water vapor during the feeding of the warm water and to reduce noise to the highest degree.

Moreover, the boiler 2 is installed with an electric heater 3 at the inside thereof for heating the fed cool water thus generating the warm water and vapor. The electric heater 3, as shown in FIG. 1, is horizontally installed to the lower side of the boiler 2 and spaced apart from the bottom surface of the boiler 2 by a predetermined distance so as not to come in contact with the bottom surface.

The reason that the electric heater 3 must be installed at the lower side of the boiler 2 in a manner of being horizontally nearby the bottom surface of the boiler 2 will be described as follows.

When the cool water fed from the water tank 1 to the boiler 2 is heated, the water vapor is generated and the vapor pressure is increased so that the discharging valve 10 is opened and the warm water is discharged from the boiler 2 thereby the level of the warm water is gradually lowered. In order to discharge all warm water and feed it to the heat exchanging section 4, it is required to generate the vapor in the boiler 2 continuously in order to keep the vapor pressure at a predetermined degree until the warm water is completely discharged. And this is possible when the electric heater 3 is installed at the lower side of the boiler 2 in a manner of being horizontally nearby the bottom surface of the boiler 2 since it can maintain maximum contact with the warm water and heat the warm water and generate the vapor although the level of the warm water descends and thereby all water in the boiler 3 can be discharged.

If the electric heater 3 is installed at the upper side of the boiler 2 or other place different from the present invention, after a predetermined amount of the warm water has been discharged, the rest of the warm water becomes not in direct contact with the electric heater 3 thereby the heat transfer cannot be easily performed and the vapor pressure cannot be maintained at a predetermined degree so that all the warm water in the boiler 2 cannot be circulated.

In the mean time, if the electric heater 3 is installed on the bottom surface of the boiler 2, the heat from the electric heater 3 is transferred to the surfaces of the boiler 2 and the heat is transferred to the vapor through the surfaces thereby heat loss cannot be easily performed so that the vapor pressure in the boiler 2 cannot be decreased even after all warm water is discharged.

If the vapor pressure is not decreased, the feed valves 8 and 9 are not opened and the feeding of the cooling water is interrupted so that a cycle of circulating the warm water cannot be completed. Thus, it is preferred that the electric heater 3 is installed not to be in contact with the bottom surface of the boiler 2.

In addition, it is preferred that the entire surface of the electric heater 3 is sealed with a stainless film 13 for preventing corrosion. The surface of the electric heater 3 tends to be corroded due to repeated contact with the cool water and the warm water.

Therefore, it is possible to prevent the electric heater 3 from corroding in a short time by sealing the entire surfaces of the electric heater 3 with a shield film made of the stainless film 13.

As shown in FIG. 1, the boiler 2 is installed with a temperature measuring controller 11 at the outside thereof, which serves as a safety device for measuring the internal temperature of the boiler 2 and controlling electric power supplied to the electric heater 3.

Figure 2:
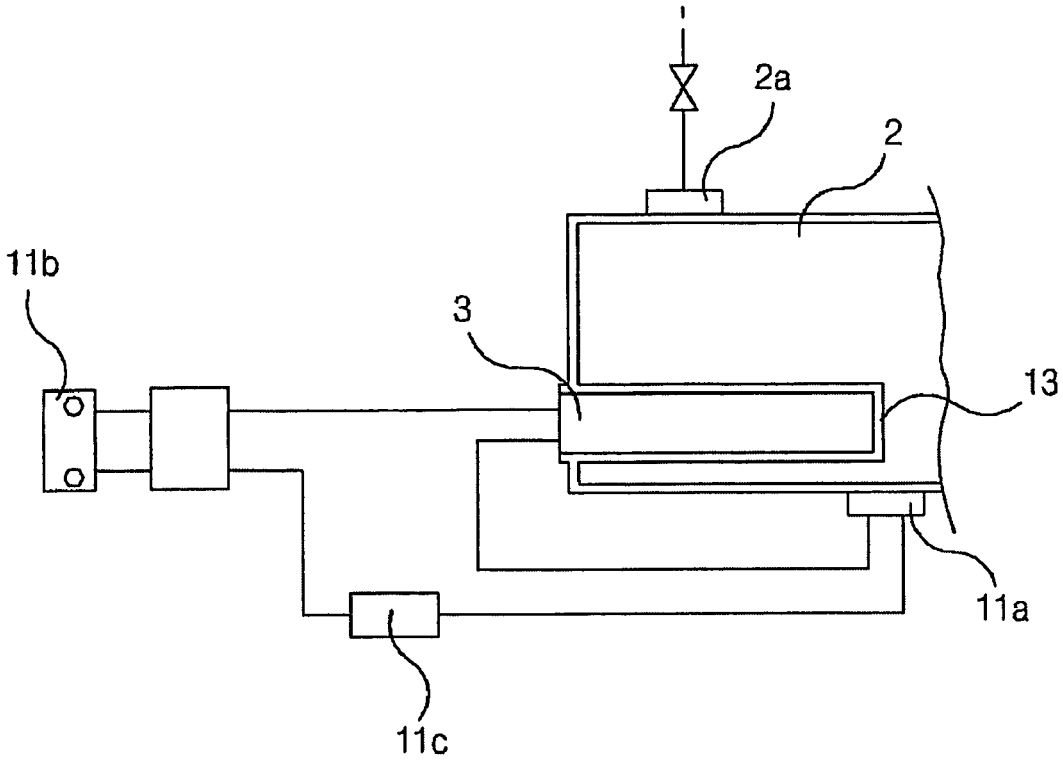
FIG. 2 is a schematic view illustrating a temperature controller of the automatic circulation device of warm water according to the present invention.

FIG. 2 is a schematic view illustrating the temperature controller 11 of the automatic circulation device of warm water according to the present invention. As shown in the drawing, the temperature controller 11 includes a temperature sensor 11*a* attached to the upper side or the lower side of the boiler 2 for sensing the internal temperature of the boiler 2, and a temperature controlling section 11*c* electrically connected to an electric power source 11*b* of the electric heater 3 for receiving a measuring signal from the temperature measuring sensor 11*a* and interrupting the electric power supplied to the electric heater 3 when the internal temperature of the boiler 2 exceeds a predetermined temperature.

When the vapor pressure in the boiler 2 is not decreased and the internal temperature is increased even after all the warm water in the boiler 2 has been discharged through the discharging valve 10, the temperature controller 11 interrupts the electric power supplied to the electric heater 3 thereby the vapor pressure in the boiler 2 decreases so that the cool water is fed and the circulation cycle start again.

Since the temperature controller 11 is merely a safety device, in order to automatically circulate the warm water without interruption of the electric power supplied to the electric heater 3 by the temperature controller 11, the size of the boiler 2 and the capacity of the electric heater 3 are important. If the capacity of the electric heater 3 is too small or large in comparison with the size of the boiler 2, the circulation of the warm water cannot be automatically operated.

If the capacity of the electric heater 3 is too small in comparison with the size of the boiler 2, it is difficult to generate the vapor from the cool water so that the vapor pressure sufficient for discharging the warm water cannot be generated. If the capacity of the electric heater 3 is too large in comparison with the size of the boiler 2, the vapor pressure in the boiler 2 is not rapidly decreased after discharging the warm water so that discharging of the warm water must be performed by the interruption of the electric power by the temperature controller 11.

In order to continuously circulate the warm water in the present invention without dependency on the temperature controller 11, it is preferred that the temperature of the warm water discharged from the boiler 2 is below 95° C. and the temperature of the vapor in the boiler 2 when discharging the warm water is within a range of 100° C. to a temperature slightly exceeding 100° C.

If the temperature of the vapor in the boiler 2 considerably exceeds 100° C., it takes a lot of time for heat loss necessary for condensing the vapor after discharging the warm water so that the electric heater 3 is overheated and then the temperature controller 11 is operated. Therefore, the capacity of the electric heater 3 must be selected within a proper range of the capacity to suit for the size of the boiler 2, and must not be too small or too large.

According to experimentation based on the present invention, under the condition that the volume of the boiler 2 is 100 cc and 100 cc of cool water of 20° C. is heated with an electric heater having capacity of 30 W, the energy required to produce and feed warm water at 100° C. is about 8,540 cal, that is, 35,868 J and the time required to circulate the warm water is about 20 minutes. At this time, the temperature of the warm water discharged from the boiler 2 was 95° C. and has been ascended to 100° C. when the warm water is finally discharged from the boiler 2.

According to the other experiments, under the condition that the volume of the boiler 2 is 100 cc and the water is heated with an electric heater 3 having a capacity of 2,400 W, the temperature of the warm water discharged from the boiler 2 ranges from 65° C. to 70° C. and it takes about 5 seconds to circulate the warm water.

Analyzing the above experiments together, in order to automatically produce and circulate the warm water in the automatic circulation device of warm water according to the present invention, it is preferred that the electric heater 3 is selected within a range of a minimal capacity of 300 W to a maximal capacity of 2,400 W, on the basis of the 100 cc volume of the boiler 2.

Obviously, if the volume of the boiler 2 is changed, the capacity of the electric heater 3 must also be selected within a proper range in a manner that the vapor pressure can be generated and decreased so as to automatically circulate the warm water.

Figure 3:
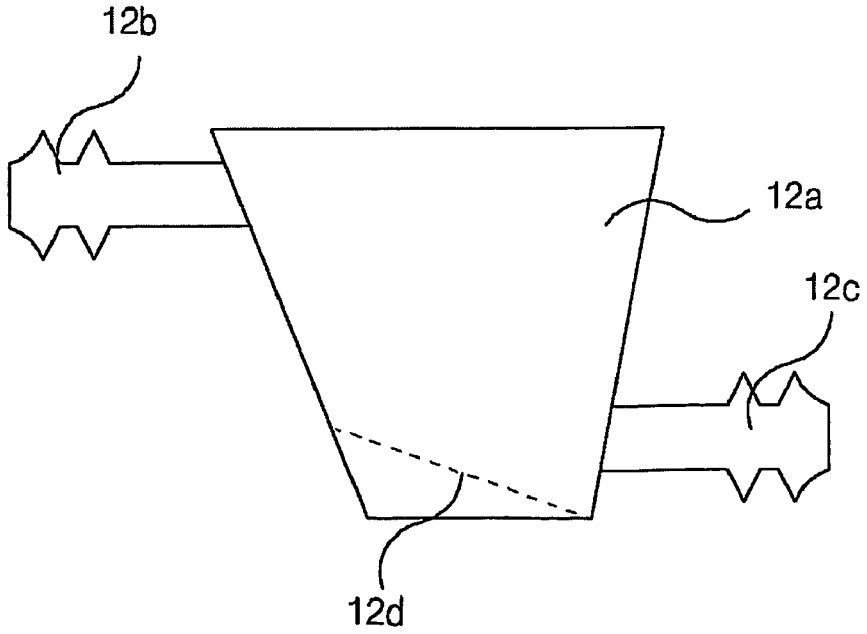
FIG. 3 is a schematic view illustrating a muffler of the automatic circulation device of warm water according to the present invention.

FIG. 3 is a schematic view illustrating a muffler 12 of the automatic circulation device of warm water according to the present invention.

As shown in the drawing, the muffler 12 includes a muffler body 12*a* having an internal space with a wide upper side and a narrow lower side and formed with an inclined surface 12*d* at the bottom surface thereof, an inlet pipe 12*b* installed to the upper side of the muffler body 12*a*, and an outlet pipe 12*c* installed to the lower side of the muffler body 12*a*.

The muffler 12 is preferably installed to the discharging pipe 6 to be disposed downstream of the discharging valve 10.

The muffler 12 serves to prevent that noise and vibration from being generated from the discharging pipe 6. When the cool water in the boiler 2 is heated by the electric heater 3, it is transformed into the vapor and thereby the vapor pressure is increased so that the warm water begins to be discharged. At the first time of discharging the warm water, the vapor pressure is weak so that the warm water is gradually discharged, however when the level of the warm water gets lowered, the amount of the vapor generated per unit time is more increased and thereby the vapor pressure is also increased.

After discharging most of the warm water from the boiler 2, that is, when the level of the warm water descends to the point near to the bottom surface of the electric heater 3, the vapor pressure in the boiler 2 is more increased so that not only the rest of the warm water but also the vapor in the boiler 2 are discharged due to high pressure of vapor through a discharging port of the boiler 2 at this time. This discharged warm water and vapor cause resonance or water hammering in the discharging pipe 6 so that noise and vibration may be generated from the discharging pipe 6.

In order to prevent the noise and vibration, as shown in the drawings, it is preferable that the muffler body 12*a* of the muffler 12 is larger than the diameter of the discharging pipe 6 so as to secure a space for decreasing the vapor pressure and has a cylinder or square pillar shape with a wide upper side and a narrow lower side so that its sectional area is gradually decreased from the upper side to the lower side thereof.

When the warm water and the vapor are introduced into the muffler body 12*a* through the inlet 12*b*, the warm water is separated from the vapor due to the difference of specific gravity such that the warm water is filled in the inner lower side of the muffler body 12*a* and the vapor occupies the inner upper side of the muffler body 12*a*.

In order to prevent the warm water from being discharged together with the vapor at the inner upper side of the muffler body 12*a* when the separated warm water is discharged through the outlet 12*c* of the muffler 12, the muffler body 12*a* is manufactured to have the narrower lower side than the upper side thereof so as to fill the warm water to the highest degree of the height of the outlet 12*c*, in addition, the muffler body 12*a* is preferably formed with the inclined surface 12*d* having a predetermined slope at the bottom surface so as to easily discharge the warm water.

The heater exchanging section 4 of the present invention includes an inlet port 4*a* connected to the discharging port 2*b* of the boiler 2 by means of the discharging pipe 6 and an outlet port 4*b* connected to the water tank 1 by means of the circulation pipe 7 so that it receives the warm water from the discharging pipe 6 and transfers heat to the exterior and circulates the cooled cool water to the water tank 1 again through the circulation pipe 7.

The heat exchanging section 4 can be applied to various products such as mats, comforters or the like. In order to easily apply the automatic circulation device of warm water according to the present invention to above various products, it is preferred that the heat exchanging section 4 includes a quick connector 14 at the connected portions so as to be easily connected to and disconnected from the discharging pipe 6 and the circulation pipe 7.

Figure 4:
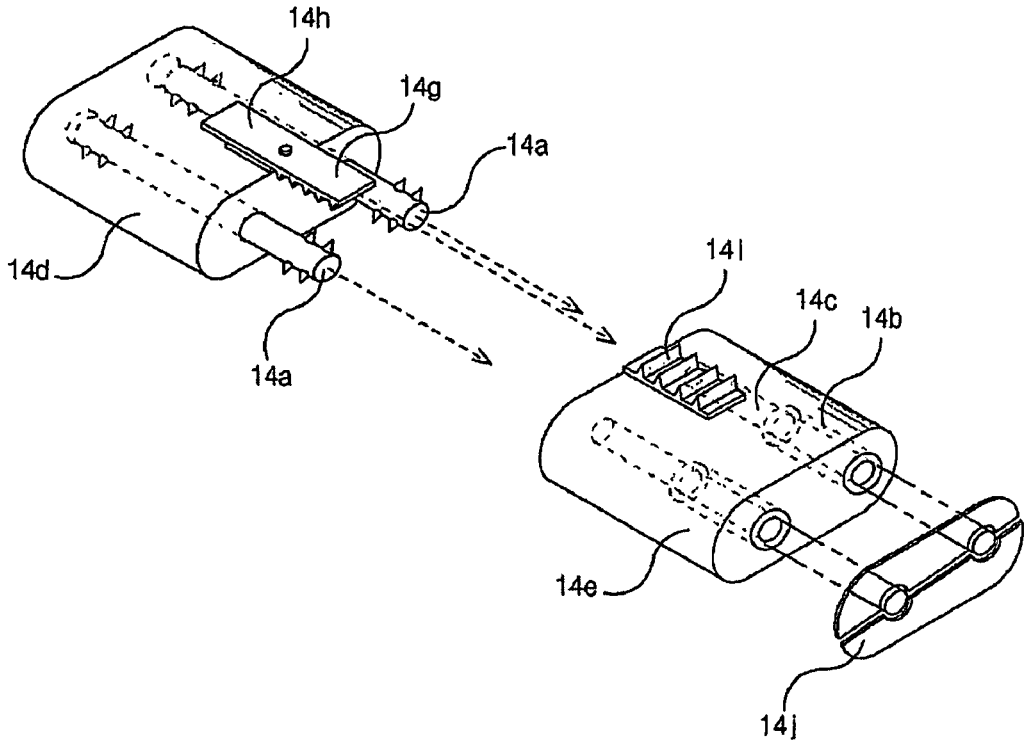
FIG. 4 is a schematic view illustrating a quick connector of the automatic circulation device of warm water according to the present invention.

FIG. 4 is a schematic view illustrating the quick connector 14 of the automatic circulation device of warm water according to the present invention. As shown in the drawing, the quick connector 14 includes a pair of male plugs 14*a* formed with protrusions symmetrically protruded from both sides of the male plugs 14*a* and having diameters gradually decreased toward their ends, a pair of female plugs 14*c* having one side into which the protrusions of the male plugs 13*a* are inserted and the other side on which silicon tubes 14*b* and a silicon cover 14*j* are coupled, and a fixing device respectively installed to a male plug case 14*d* in which the male plugs 14*a* are installed at the inside and to a female plug case 14*e* in which the female plugs 14*c* are installed at the inside so as to adjust the depth of the connection of the plugs 14*a* and 14*c*.

The male plugs 14*a* form a pair; one of the male plugs 14*a* has one side connected to the discharging pipe 6 and the other side connected to one of the female plugs 14*c* connected to the inlet port 4*a* of the heat exchanging section 4, and the other of the male plugs 14*a* has one side connected to the circulation pipe 7 and the other side connected to the other one of the female plugs 14*c* connected to the outlet port 4*b* of the heat exchanging section 4.

The female plugs 14*c* form a pair like the male plugs 14*a;* one of the female plugs 14*c* is connected to one of the male plugs 14*a* and the other one is inserted into the silicon tube 14*b* and connected to the silicon cover 14*j*, so that the female plugs 14 are connected to the inlet port 4*a* and the outlet port 4*b* of the heat exchanging section 4. Here, the silicon cover 14*j* serves to protect the connected portions.

For the purpose of enhancing the connection and watertightness, it is preferred that the male plugs 14*a* have a diameter slightly larger than that of the female plugs 14*c*, and the female plugs 14*c* are made of resilient silicon having good thermal endurance and capable of preventing water leakage of the connected portion.

Moreover, the male plug case 14*d* and the female plug case 14*e* into which the male plugs 14*a* and the female plugs 14*c* are installed with the fixing device for adjusting the depth of the connection of the plugs 14*a* and 14*c*. The fixing device includes a male plug fixing section 14*g* and an adjusting section 14*h* installed to the male plug case 14*d*, and a female plug fixing section 14*i* formed at the female plug case 14*e*, so that the connection depth of the plugs 14*a* and 14*c* is adjusted by adjusting the engaging degree of teeth of the plug fixing sections 14*g* and 14*i* by means of the adjusting section 14*h*.

The discharging pipe 6 disposed downstream of the discharging valve 10 may be divided into two sub-pipes and each of the sub-pipes is installed with flow rate adjusting devices so as to respectively adjust the amount of the warm water fed to the heat exchanging section 4.

This is especially applicable when the heat exchanging section 4 is applied to mats or the like, which may be used by several users since the temperature desired by each user may be different. The discharging pipe 6 is divided into two sub-pipes and flow rate adjusting devices for adjusting the flow rate of the warm water are respectively installed to each of the sub-pipes so as to duplicate the pipes in the heat exchanging section 4 and control the warm water introduced into the duplicated pipes thereby the user can easily adjust the temperature of each mat as needed.

Figure 5:
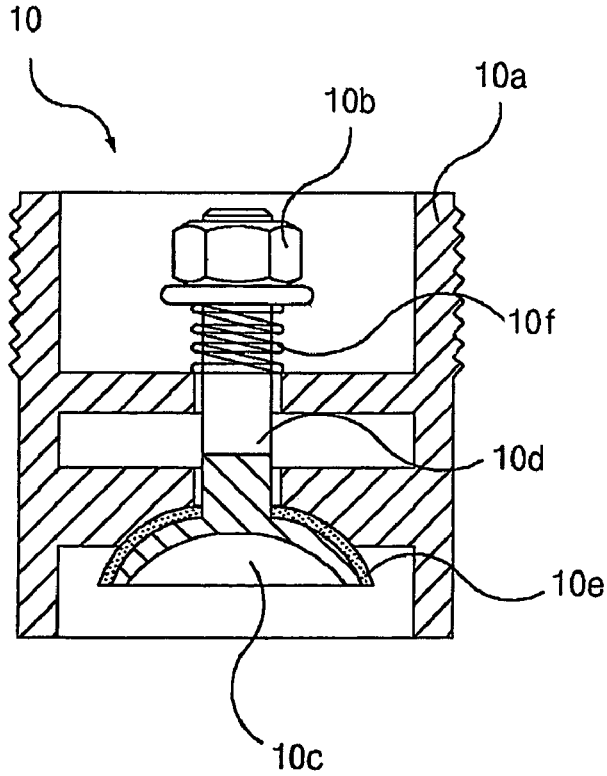
FIG. 5 is a schematic view illustrating a discharging valve of the automatic circulation device of warm water according to the present invention.

FIG. 5 is a schematic view illustrating the discharging valve 10 of the automatic circulation device of warm water according to the present invention. As shown in the drawing, the discharging valve 10 includes a valve case 10*a*, a valve stem 10*d* penetrating a hole formed in the valve case 10*a* and having one end to which a nut 10*b* is coupled and the other end formed with a valve head 10*c*, a valve membrane cover 10*e* coupled with the valve head 10*c* and securing water tightness between the hole in the valve case 10*a* and the valve head 10*c*, and a compressing spring 10*f* installed around the valve stem 10*d*, compressed and fixed by the nut 10*b* and providing elastic force to make the valve membrane cover 10*e* closely contact the hole of the valve case 10*a*.

The discharging valve 10 is closed by the compression spring 10*f* in the normal state, and is opened by the downward movement of the valve stem 10*d* when the vapor pressure of the boiler 2 is larger than the elastic force of the compression spring 10*f*, so that the warm water in the boiler 2 is discharged through the discharging pipe 6.

That is, the discharging valve 10 is closed when the vapor pressure of the boiler 2 is less than the elastic force of the compression spring 10*f* and is opened when the vapor pressure of the boiler 2 is greater than the elastic force of the compression spring 10*f* thus the discharging valve 10 is automatically opened and closed due to the vapor pressure.

As the elastic force of the compression spring 10*f* of the discharging valve 10 gets greater, the vapor pressure in the boiler 2 for discharging the warm water should become greater. Accordingly, in order to feed the warm water to a higher or a remote place, the elastic force of the compression spring 10*f* should become greater. However in this case there may be a problem that the vapor's temperature becomes too high thus it may take a lot of time to circulate the warm water. Therefore it is preferred that the compression spring 10*f* is selected from springs having elastic force within an appropriate range.

And the feed valves preferably include a cone-type feed valve and a cylinder-type feed valve installed to the feed pipe 5 in serial fashion.

Figure 6:
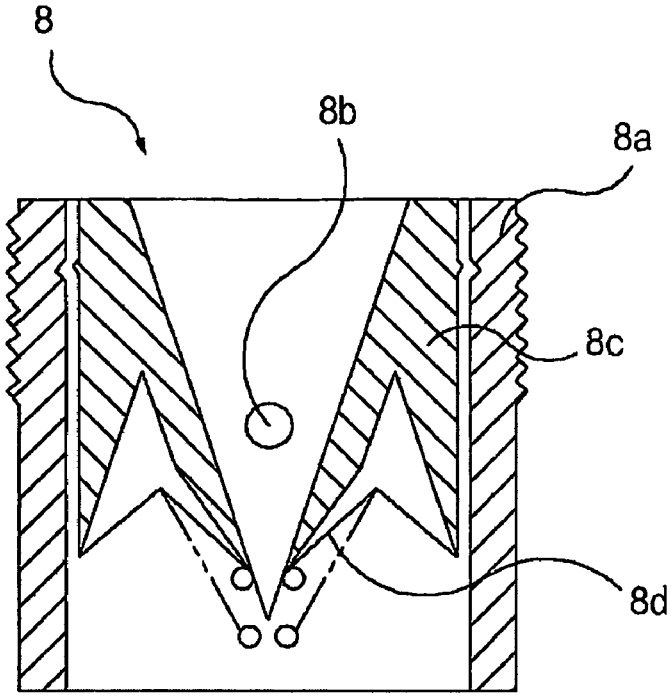
FIG. 6 is a schematic view illustrating a cone-type feed valve of the automatic circulation device of warm water according to the present invention.

FIG. 6 is a schematic view illustrating a cone-type feed valve 8 of the automatic circulation device of warm water according to the present invention. As shown in the drawing, the cone-type feed valve 8 includes a valve case 8*a*, a valve membrane support 8*c* installed in the valve case 8*a* and formed with a water feeding section 8*b* having a hollow cone shape, and a valve membrane 8*d* fixed between the valve case 8*a* and the valve membrane support 8*c* and having a lower end movable upward and downward by the external force.

Since the lower end of the valve membrane 8*d* comes in loose contact with the inclined surface of the valve membrane support 8*c* in a normal state, when the cool water in the boiler 2 fed from the water tank 1 is heated by the electric heater 3 and the vapor is generated, the lower end of the valve membrane 8*d* is pushed upward due to the initially generated vapor pressure and comes in close contact with the inclined surface of the valve membrane support 8*c*, so that the cone-type feed valve 8 interrupts the leakage of the vapor.

When the inside of the boiler 2 is under the low atmospheric pressure after the warm water is completely discharged, the valve membrane 8*d* is lowered and the cone-type feed valve 8 is opened, so that the cool water is fed to the boiler 2.

Figure 7:
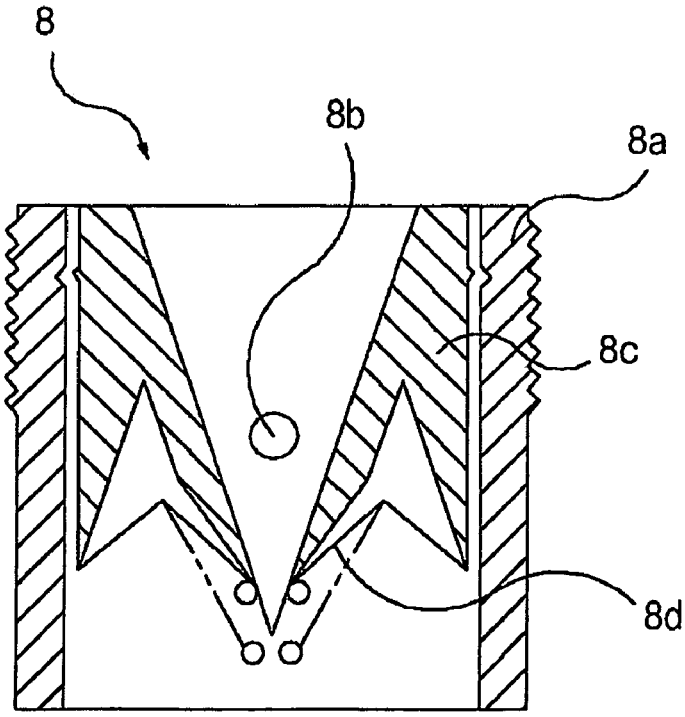
FIG. 7 is a schematic view illustrating a cylinder-type feed valve of the automatic circulation device of warm water according to the present invention.

FIG. 7 is a schematic view illustrating the cylinder-type feed valve 9 of the automatic circulation device of warm water according to the present invention. As shown in the drawing, the cylinder-type feed valve 9 includes a valve case 9*a*, a valve body 9*b* installed in the valve case 9*a* and freely moved upward and downward, and a spring 9*c* having one end fixed to the lower end of the valve case 9*a* and the other end coupled with the inner upper side of the valve body 9*b*, and providing an elastic force to raise the valve body 9*b*.

The valve body 9*b* comes in loose contact with the valve case 9*a* by the elastic force of the spring 9*c* in a normal state, and comes in more strong contact with the valve case 9*a* due to the initially generated vapor pressure when the cool water in the boiler 2 is heated by the electric heater 3 and the vapor is generated, so that the cylinder-type feed valve 9 prevents the leakage of the vapor pressure in the boiler 2. Further, when the inside of the boiler 2 is under the low atmospheric pressure after the warm water is completely discharged, the spring 9*c* is lowered and the valve body 9*b* moves downward to open the cylinder-type valve 9, so that the cool water is fed from the water tank 1 to the boiler 2.

The above two feed valves 8 and 9 enable normal circulation of the warm water in such a manner that when one is damaged or unable to operate due to foreign matter, it is assisted by the other.

Since the feeding time of the cool water is determined according to the elasticity of the valve membrane 8*d* of the cone-type feed valve 8 and the strength of the spring 9*c* of the cylinder-type feed valve 9, they must be selected within a proper range and preferably in a range that the elasticity of the valve membrane 8*d* and the strength of the spring 9*c* are slightly greater than sum of the weight of the cool water in the feed pipe 5 fed from the water tank 1 and the weight of the valve membrane 8*d* or the valve body 9*c* itself so that the valves 8 and 9 are weakly closed if there is no external load.

The vapor pressure in the boiler 2 is rapidly decreased after the warm water is discharged, therefore if the feed valves 8 and 9 are not sufficiently large, the time required for feeding the warm water is increased and frictional noise may be generated. Thus, it is preferred that the sizes of the feed valves 8 and 9 are properly selected in order to reduce the noise.

[Mode for Invention]

The automatic circulation of warm water according to the present invention constructed as above described operates according to the following procedures.

First, the water tank 1 is sufficiently filled with cool water, and the electric heater 3 is energized with an electric power, then air within the boiler 3 is expanded so that the pressure in the boiler 2 is increased. If the internal pressure of the boiler 2 is further increased so as to open the discharging valve 10, a part of air in the boiler 2 is discharged and the temperature in the boiler 2 is further increased.

If the temperature in the boiler 2 reaches 105° C., the electric power is interrupted by the temperature controller 11. After the interruption of the electric power, the internal temperature of the boiler 2 is decreased simultaneously with the descending of the pressure in the boiler 2. If the pressure becomes low enough to overcome the elastic force of the valve membrane 8*d* of the cone-type feed valve 8 and the strength of the spring 9*c* of the cylinder-type feed valve 9, the two feed valves 8 and 9 are opened so that the cool water in the water tank 1 initiates to be fed into the boiler 2 through the feed pipe 5.

When the boiler 2 is filled with the cool water, the surface temperature of the boiler 2 becomes to drop below 105° C. and the electric heater 3 is supplied with the electric power again so as to heat the cool water in the boiler 2.

When the cool water in the boiler 2 is heated and its temperature becomes about 75° C., the vapor pressure initiates to be generated in the boiler 2. At this time, the feed valves 8 and 9 of the feed pipe 5 are closed so as to prevent the initial vapor pressure from being leaked to the exterior.

When the internal vapor pressure is further increased due to the continuous heating, the feed valves 8 and 9 are closed more strongly due to the vapor pressure. When the temperature of the warm water is continuously increased and exceeds the strength of the spring of the discharging valve 10, the discharging valve 10 is opened and the warm water in the boiler 2 is discharged through the discharging pipe 6.

Once the warm water initiates to be discharged, the level of the warm water in the boiler 2 is gradually lowered and the vapor pressure is continuously increased. After the warm water in the boiler 2 is completely discharged, no vapor is generated more even though the electric heater 3 operates and the heat generated from the electric heater 3 is not transferred well through gas, therefore the vapor pressure in the boiler 2 is gradually decreased. Thus, the vapor pressure is decreased and the interior of the boiler 2 is in the condition of low atmospheric pressure, then the feed valves 8 and 9 are automatically opened so that the cool water is fed again from the water tank 1 to the boiler 2.

When the cool water is fed to the boiler 2 again as described above, the initially fed cool water cools the interior of the boiler 2 in a short time so that it further decrease the internal pressure of the boiler 2, and the decrease of the internal pressure of the boiler 2 cause the feed valves 8 and 9 to be fully opened so as to sufficiently feed the cool water to the boiler 2.

The warm water discharged from the boiler 2 is fed to the muffler 12 installed to the discharging pipe 10 and then it is separated from the vapor in the muffler 12 so as to be fed to the heat exchanging section 4.

In the heat exchanging section 4 to which the warm water is fed, the heat is transferred from the warm water as a heat source to the exterior, and the cool water cooled after the heat transfer is discharged again through the circulation pipe 7.

The cool water discharged through the circulation pipe 7 is circulated to the water tank 1 and stored therein and as described above it is fed again to the boiler 2 so as to constitute the automatic circulation cycle of warm water.

Although the preferred embodiments of the automatic circulation device of warm water according to the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An automatic circulation device of warm water comprising:

a boiler formed with a feed port and a discharging port at the upper side and the lower side thereof, respectively, receiving cool water through the feed port, and discharging the warm water through the discharging port;

an electric heater horizontally installed at the inner lower side of the boiler without contacting the inner lower side and supplying heat to the interior of the boiler;

a water tank connected to the feed port of the boiler by means of a feed pipe and feeding the cool water to the boiler;

a heat exchanging section connected to the discharging port of the boiler by means of a discharging pipe and to the water tank by means of a circulation pipe, and transferring heat to the exterior; and a feed valve and a discharging valve respectively installed to the feed pipe and the discharging pipe, and automatically opened and closed by vapor pressure in the boiler.

2. The automatic circulation device of warm water as set forth in claim 1, further comprising a muffler installed to the discharging pipe downstream of the discharging valve and separating the warm water in the discharging valve from the vapor.

3. The automatic circulation device of warm water as set forth in claim 2, wherein the muffler comprises:

a muffler body having an internal space with a wide upper side and a narrow lower side, and an inclined surface formed at the bottom surface thereof; and an inlet pipe and an outlet pipe respectively connected to the upper side and the lower side of the muffler body.

4. The automatic circulation device of warm water as set forth in claim 1, further comprising a temperature controller for measuring the temperature in the boiler and controlling the supply of electric power to the electric heater.

5. The automatic circulation device of warm water as set forth in claim 1, further comprising a quick connector installed to an inlet port and an outlet port of the heat exchanging section and connected portions of the discharging pipe and the circulation pipe, and easily connecting and disconnecting the heat exchanging section to the discharging pipe and the circulation pipe.

6. The automatic circulation device of warm water as set forth in claim 5, wherein the quick connector comprises:

a pair of male plugs formed with protrusions symmetrically protruded from both sides of the male plugs 14*a* and having diameters gradually decreased toward their ends, a pair of female plugs having one side into which the male plugs with the protrusions are inserted and the other side on which silicon tubes and a silicon cover are coupled; and a fixing means respectively installed to a male plug case in which the male plugs are installed at the inside, and to a female plug case in which the female plugs are installed at the inside, so as to adjust the depth of the connection of the male and female plugs.

7. The automatic circulation device of warm water as set forth in claim 1, wherein the discharging pipe disposed downstream of the discharging valve is divided into two sub-pipes, and the automatic circulation device of warm water further comprises flow rate adjusting devices respectively installed to the sub-pipes and for adjusting the amount of the warm water to be fed to the heat exchanging section.

8. The automatic circulation device of warm water as set forth in claim 1, wherein the entire surface of the electric heater is sealed with a stainless film for preventing corrosion.

9. The automatic circulation device of warm water as set forth in claim 1, wherein the boiler is inclined toward the discharging port at an angle of 3 degrees to 5 degrees.

10. The automatic circulation device of warm water set forth in claim 1, wherein the discharging valve comprises:

a valve case;

a valve stem penetrating a hole formed in the valve case and having one end to which a nut is coupled and the other end formed with a valve head;

a valve membrane cover coupled with the valve head and securing watertightness between the hole in the valve case and the valve head; and a compressing spring installed around the valve stem, compressed and fixed by the nut and providing elastic force to the valve membrane cover so that it is biased against the hole of the valve case.

11. The automatic circulation device of warm water as set forth in claim 1, wherein the feed valve comprises a cone-type feed valve and a cylinder-type feed valve installed to the feed pipe in serial.

12. The automatic circulation device of warm water as set forth in claim 11, wherein the cone-type feed valve comprises:

a valve case;

a valve membrane support installed in the valve case of the cone-type feed valve and formed with a water feeding section having a hollow cone shape; and a valve membrane fixed between the valve case of the cone-type feed valve and the valve membrane support of the cone-type feed valve and having a lower end movable upward and downward by the external force;

wherein the cylinder-type feed valve comprises:

a valve case;

a valve body installed in the valve case of the cylinder-type feed valve and freely moved upward and downward; and a spring having one end fixed to the lower end of the valve case of the cylinder-type feed valve and the other end coupled with the inner upper side of the valve body of the cylinder-type feed valve, and providing an elastic force so that the valve body of the cylinder-type feed valve is raised.

* * * * *